US008938995B2

(12) United States Patent
Pernick

(10) Patent No.: US 8,938,995 B2
(45) Date of Patent: Jan. 27, 2015

(54) CIRCULAR KNITTING MACHINE WITH MOUNTING ARRANGEMENT FOR SINKER CAMS

(71) Applicant: Monarch Knitting Machinery Corporation, Monroe, NC (US)

(72) Inventor: Bruce Pernick, Stamford, CT (US)

(73) Assignee: Monarch Knitting Machinery Corporation, Monroe, NC (US)

( * ) Notice: Subject to any disclaimer, the term of this patent is extended or adjusted under 35 U.S.C. 154(b) by 0 days.

(21) Appl. No.: 13/833,225

(22) Filed: Mar. 15, 2013

(65) Prior Publication Data

US 2014/0260435 A1 Sep. 18, 2014

(51) Int. Cl.
*D04B 15/06* (2006.01)
*D04B 15/32* (2006.01)
*D04B 15/34* (2006.01)

(52) U.S. Cl.
CPC ..... *D04B 15/34* (2013.01); *D04B 15/06* (2013.01); *D04B 15/322* (2013.01)
USPC ..... 66/107

(58) Field of Classification Search
CPC ..... D04B 15/06; D04B 15/00; D04B 15/32; D04B 15/322; D04B 15/34; D04B 9/00
USPC ..... 66/104, 105, 106, 107, 108 A, 108 R
See application file for complete search history.

(56) References Cited

U.S. PATENT DOCUMENTS

| | | | | |
|---|---|---|---|---|
| 1,097,733 A | | 5/1914 | Scott | |
| 1,137,561 A | | 4/1915 | Williams | |
| 2,123,534 A | | 7/1938 | Lawson et al. | |
| 2,761,302 A | | 9/1956 | Nebel | |
| 2,966,782 A | * | 1/1961 | Deiss et al. | 66/9 R |
| 3,173,277 A | | 3/1965 | Fregeolle | |
| 3,331,219 A | | 7/1967 | Brook | |
| 3,844,141 A | * | 10/1974 | Haustein et al. | 66/108 R |
| 4,020,653 A | * | 5/1977 | Mishcon et al. | 66/93 |
| 4,037,434 A | | 7/1977 | Durville et al. | |
| 4,040,276 A | | 8/1977 | Koegel | |
| 4,137,728 A | | 2/1979 | Durville | |

(Continued)

FOREIGN PATENT DOCUMENTS

| | | |
|---|---|---|
| CN | 2195558 Y | 4/1995 |
| CN | 1382853 A | 12/2002 |

(Continued)

OTHER PUBLICATIONS

International Search Report and Written Opinion from International Application No. PCT/US2014/024042, dated Jul. 10, 2014.

*Primary Examiner* — Danny Worrell
(74) *Attorney, Agent, or Firm* — Alston & Bird LLP

(57) ABSTRACT

Sinker cam segments in a circular knitting machine are located with respect to the generally radial direction by a generally radially inwardly facing location surface disposed radially outward of the segments. Each segment's radially outer end defines a contact region that abuts the locating surface. The contact region can be complementary surface contour to that of the locating surface, or a pair of discrete, spaced contact points protruding out from the radially outer end of the segment. The contact region is a reference for positioning the sinker cam segment with respect to the generally radial direction.

19 Claims, 4 Drawing Sheets

(56) References Cited

U.S. PATENT DOCUMENTS

| | | | | |
|---|---|---|---|---|
| 4,156,356 | A * | 5/1979 | Holder | 66/108 R |
| 4,180,993 | A | 1/1980 | Philip | |
| 4,665,718 | A | 5/1987 | Jelinek et al. | |
| 4,798,064 | A | 1/1989 | Elsasser et al. | |
| 4,920,767 | A | 5/1990 | Plath et al. | |
| 4,955,211 | A | 9/1990 | Neher | |
| 5,048,313 | A | 9/1991 | Vignoni | |
| 5,138,848 | A * | 8/1992 | Schnurrer et al. | 66/57 |
| 5,172,569 | A | 12/1992 | Schnurrer | |
| 5,182,927 | A | 2/1993 | Pernick | |
| 5,243,839 | A | 9/1993 | DiGiuseppe et al. | |
| 5,279,133 | A * | 1/1994 | Plath | 66/9 R |
| 5,426,957 | A | 6/1995 | Yamaoka | |
| 5,511,393 | A | 4/1996 | Hu | |
| 5,613,375 | A | 3/1997 | Renda et al. | |
| 5,881,571 | A | 3/1999 | Reester | |
| 6,089,047 | A | 7/2000 | Wang | |
| 6,237,371 | B1 | 5/2001 | Hsieh | |
| 6,269,665 | B1 | 8/2001 | Wang | |
| 6,393,870 | B2 | 5/2002 | Eppler et al. | |
| 6,519,978 | B2 | 2/2003 | Pernick et al. | |
| 6,799,444 | B1 | 10/2004 | Wang | |
| 7,152,436 | B2 | 12/2006 | Wang | |
| 7,607,322 | B1 | 10/2009 | Pernick | |
| 7,827,828 | B2 | 11/2010 | Pernick | |
| 7,942,021 | B2 | 5/2011 | Stingel | |
| 2013/0239624 | A1 | 9/2013 | Eppler | |
| 2013/0276482 | A1 | 10/2013 | Hoffman | |

FOREIGN PATENT DOCUMENTS

| | | | |
|---|---|---|---|
| CN | 201148504 | Y | 11/2008 |
| DE | 20 2010 013 114 | U1 | 3/2011 |
| GB | 2 267 292 | A | 12/1993 |
| TW | 422220 | U | 2/2001 |
| WO | WO-02/053818 | A1 | 7/2002 |
| WO | WO 2010/077817 | A2 | 7/2010 |
| WO | WO 2012/059317 | A1 | 5/2012 |
| WO | WO 2012/079763 | A2 | 6/2012 |

* cited by examiner

CIRCULAR KNITTING MACHINE WITH MOUNTING ARRANGEMENT FOR SINKER CAMS

BACKGROUND OF THE INVENTION

The present disclosure relates generally to circular knitting machines having needles and sinkers that cooperate to form stitch loops. The disclosure relates more particularly to circular knitting machines having sinkers whose movements are controlled by sinker cam segments that make up a sinker cam ring.

In circular knitting machines employing sinkers, the sinker cam segments typically are individually mounted and adjusted in position using, for instance, a spacer jig and/or a dial indicator. The radial positioning of the sinker cam segments is important to the proper functioning of the sinkers to achieve the desired knit characteristics in the knitted fabric. The installation and adjustment of the sinker cam segments is a painstaking and laborious process, and is also subject to inaccuracies, particularly with respect to segment-to-segment variations. The process is made all the more difficult by the usually present support posts and drives that must be worked around.

BRIEF SUMMARY OF THE DISCLOSURE

Described herein are embodiments of a circular knitting machine that can achieve accurate sinker cam segment locations without the use of jigs and indicators, and subject to a minimal amount of human error. This not only saves time and relieves the technician of a tedious job, but allows an accuracy that is much needed in high speed knitting, where sinkers and sinker cams can wear in short periods of time. The improved accuracy between sinker cams, using the method and apparatus disclosed herein, can allow smoother transitions for the sinkers between cam segments, thereby lowering impact forces and vibration caused by impact. The improved accuracy is also beneficial when knitting fine knits, where inaccurate sinker cam settings can be a source of barre.

Without the need for jigs, indicators, etc., each cam segment can simply be screwed down, with the cam segment being forced against a radial locating surface easily manufactured at the same time as the turning of the sinker cam ring.

Accordingly, described herein are embodiments including a circular knitting machine, comprising:

a cylinder;

needle cams disposed about the cylinder and defining a cam track having cam surfaces;

knitting needles having needle butts engaged in the cam track such that relative rotation between the cylinder and needle cams causes the needles to be raised and lowered by engagement between the cam surfaces and needle butts;

sinkers disposed about the cylinder, each of the sinkers having a first sinker butt, the sinkers being arranged for inward and outward movement along a generally radial direction;

a sinker cam ring disposed about the cylinder and comprising a plurality of sinker cam segments arranged edge-to-edge to form the sinker cam ring, the sinker cam segments being mounted, by a fastening arrangement including fasteners, to a stationary sinker cap assembly of the machine;

each sinker cam segment defining a segment of a sinker cam track for the sinkers, each sinker cam segment having a contact region located at a generally radially outermost edge of the sinker cam segment, there being a predetermined positional relationship, with respect to the generally radial direction of movement of the sinkers, between the segment of the sinker cam track and the contact region, whereby the contact region forms a reference surface for positioning of the sinker cam segment with respect to the generally radial direction;

the sinker cap assembly defining a locating surface facing inwardly in the generally radial direction and opposing the contact region of each sinker cam segment;

wherein the fastening arrangement for mounting the sinker cam segments is structured and arranged to allow a defined amount of generally radially inward and outward adjustment of each sinker cam segment such that the contact region of each sinker cam segment is urged against the locating surface and is then fixed in place by the fastening arrangement, thereby determining a positioning of the sinker cam segment in the generally radial direction.

In some embodiments, the contact region of each sinker cam segment comprises a contact surface that has a complementary shape to that of the locating surface.

In other embodiments, the contact region of each sinker cam segment comprises discrete, spaced contact points that contact the locating surface. There can be two spaced contact points.

In a particular embodiment, the sinker cam segments are structured and arranged to allow a spacing distance between the contact points to be changed, and the locating surface is contoured such that changing said spacing distance results in a generally radially inward or outward adjustment of the position of the sinker cam segment. This can allow an adjustment of the "push" (i.e., the position of the sinkers at the radially inwardmost position reached during its inward travel) of the sinkers.

In other embodiments, adjustment of the push can be accomplished by providing the machine with at least one replacement sinker cam segment for each sinker cam segment installed in the machine. Each replacement sinker cam segment defines a segment of a sinker cam track substantially identical to that of the installed sinker cam segment but located at a distance from the contact region, measured along the generally radial direction, that differs by a predetermined amount from a corresponding distance of the installed sinker cam segment.

Yet other embodiments accomplish the push adjustment by providing shims for selected ones of the sinker cam segments, the shims being disposed between the contact regions of the selected sinker cam segments and the locating surface for adjusting the push of the selected sinkers.

The present disclosure also describes a sinker cam ring for a circular knitting machine having sinkers, comprising:

a plurality of sinker cam segments arranged edge-to-edge to form the sinker cam ring, the sinker cam segments being mountable, by a fastening arrangement including fasteners, to a stationary sinker cap assembly of the machine;

each sinker cam segment defining a segment of a sinker cam track for the sinkers, each sinker cam segment having a contact region located at a generally radially outermost edge of the sinker cam segment, there being a predetermined positional relationship, with respect to a generally radial direction of movement of the sinkers, between the segment of the sinker cam track and the contact region, whereby the contact region forms a reference surface for positioning of the sinker cam segment with respect to the generally radial direction.

Also described herein is a sinker cam segment defining a segment of a sinker cam track for sinkers in a circular knitting machine. The sinker cam segment has a contact region located at a generally radially outermost edge of the sinker cam segment, there being a predetermined positional relationship, with respect to a generally radial direction of movement of the sinkers, between the segment of the sinker cam track and the contact region. Thus, the contact region forms a reference surface for positioning of the sinker cam segment with respect to the generally radial direction.

BRIEF DESCRIPTION OF THE SEVERAL VIEWS OF THE DRAWING(S)

Having thus described the invention in general terms, reference will now be made to the accompanying drawings, which are not necessarily drawn to scale, and wherein:

DETAILED DESCRIPTION OF THE DRAWINGS

The present invention now will be described more fully hereinafter with reference to the accompanying drawings in which some but not all embodiments of the inventions are shown. Indeed, these inventions may be embodied in many different forms and should not be construed as limited to the embodiments set forth herein; rather, these embodiments are provided so that this disclosure will satisfy applicable legal requirements. Like numbers refer to like elements throughout.

Figure 1:
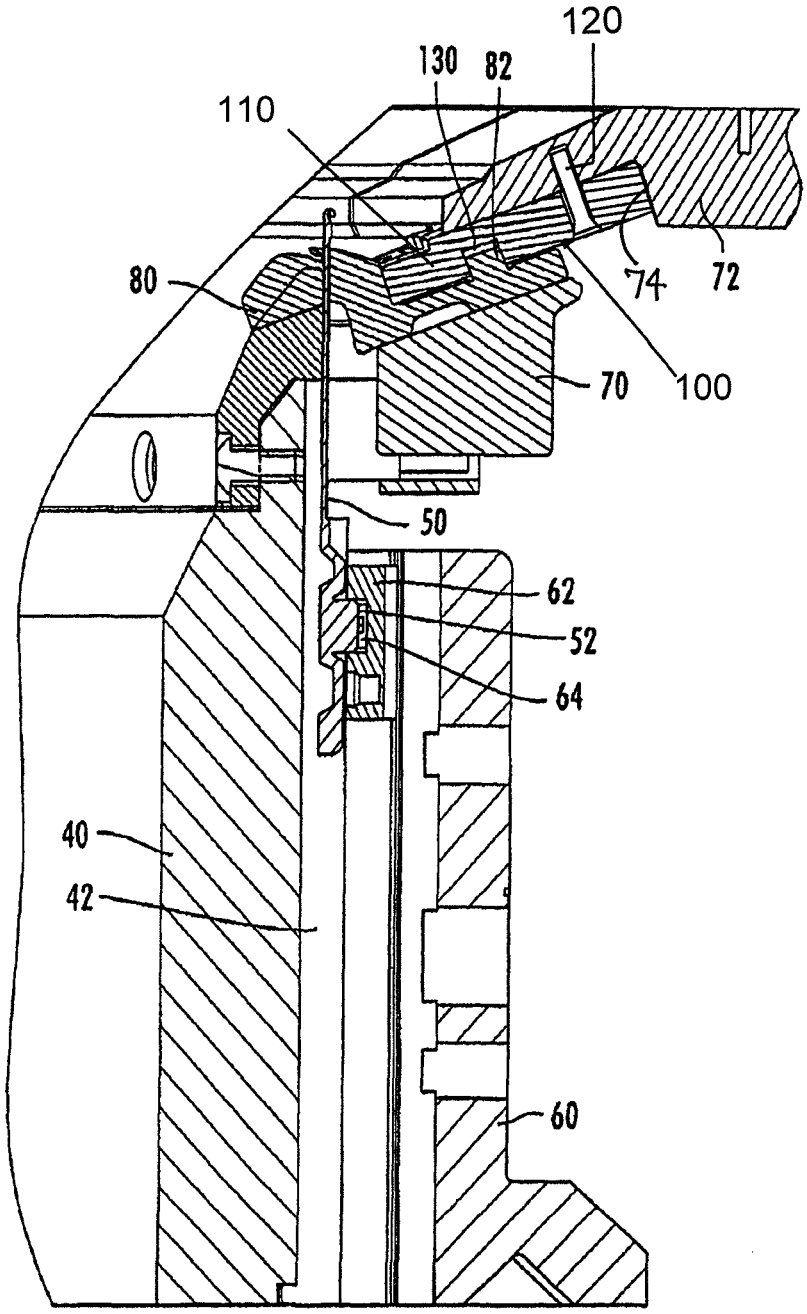
FIG. 1 is a cross-sectional view of a circular knitting machine in accordance with one embodiment of the invention, showing the components pertinent to the present disclosure while omitting some non-pertinent components.

FIG. 1 is cross-sectional view of a circular knitting machine in accordance with one embodiment of the present invention. The knitting machine includes a cylinder 40 that is rotatable about its central axis, which is oriented vertically. The cylinder 40 defines a plurality of vertical channels or tricks defined between circumferentially spaced, vertical trick walls 42 disposed at the outer peripheral surface of the cylinder. A needle 50 is disposed in each trick. Each needle has a butt 52 that projects radially outwardly. The machine includes a stationary cam box 60 that surrounds the cylinder 40. A plurality of needle cams 62 are mounted on the cam box and collectively define a needle cam track 64 in which the needle butts 52 are disposed. Rotation of the cylinder 40 about its axis carries the needles 50 about a circular path and the needle butts 52 travel along the need cam track 64. Cam surfaces defined by the needle cam track cause each of the needles to be raised and lowered in a fashion dictated by the shapes of the cam surfaces.

The circular knitting machine also includes a sinker trick ring 70 that is affixed to the outside top of the cylinder 40 and thus rotates with it. A stationary sinker cam cap 72 is mounted adjacent the sinker trick ring. A sinker cam ring 100 is mounted on the sinker cam cap 72. The sinker cam ring defines a sinker cam track 130. A plurality of sinkers 80 (generally one between every pair of adjacent needles 50) are carried by the sinker trick ring 70 and each is disposed in a sinker trick defined by the sinker trick ring. The sinkers are movable inwardly and outwardly, in a generally horizontal or radial direction, in their respective sinker tricks. In the illustrated embodiment, the sinkers are arranged to travel inwardly and outwardly along a direction that is not purely horizontal/radial, but rather is inclined relative to horizontal at an angle, such as approximately about 20° or any other suitable angle. However, throughout the present application, references to the sinkers moving or being accelerated "radially" will be understood to mean that the movement or acceleration has a radial component, but is not necessarily purely radial.

Each sinker has a butt 82 disposed in the sinker cam track 130. When the sinkers are carried about their circular path by rotation of the cylinder and hence rotation of the sinker trick ring, the sinker butts 82 travel along the sinker cam track 130. Working surfaces defined by the sinker cam track cause each of the sinkers to be advanced radially inwardly and retracted radially outwardly in a fashion dictated by the shapes of the working surfaces. The needles 50 and sinkers 80 cooperate to form stitch loops, as well known in the art.

The sinker cam ring 100 is made up of a plurality of sinker cam segments 110 arranged edge-to-edge to form the ring. The sinker cam segments are mounted on the sinker cam cap 72 by a fastening arrangement that includes fasteners 120. The sinker cam segments collectively define a sinker cam track 130 along which the sinker butts 82 travel. The surfaces of the cam track acting on the sinker butts cause the sinkers to be moved radially inwardly and outwardly.

The sinker cam segments 110 are radially located by a locating surface 74 of the sinker cam cap 72. The locating surface of the sinker cam cap opposes a corresponding contact region on each sinker cam segment. The fastening arrangement for the segments is structured and arranged to allow a defined amount of generally radially inward and outward adjustment of each sinker cam segment as it is being screwed down to fix it in place, such that the contact region of each sinker cam segment is urged against the locating surface, thereby determining a positioning of the sinker cam segment in a generally radial direction. This radial locating surface 72 can be highly accurate. The radial movement capability of the sinker cam segments during mounting can be accomplished, for example, by providing an oversized-hole (relative to the diameter of the fastener 120) in the sinker cam segment, so that the segment can be urged in a generally radially outward direction so as to contact the locating surface of the sinker cam cap, after which the fastener 120 is tightened to fix the segment in place.

Figure 2:
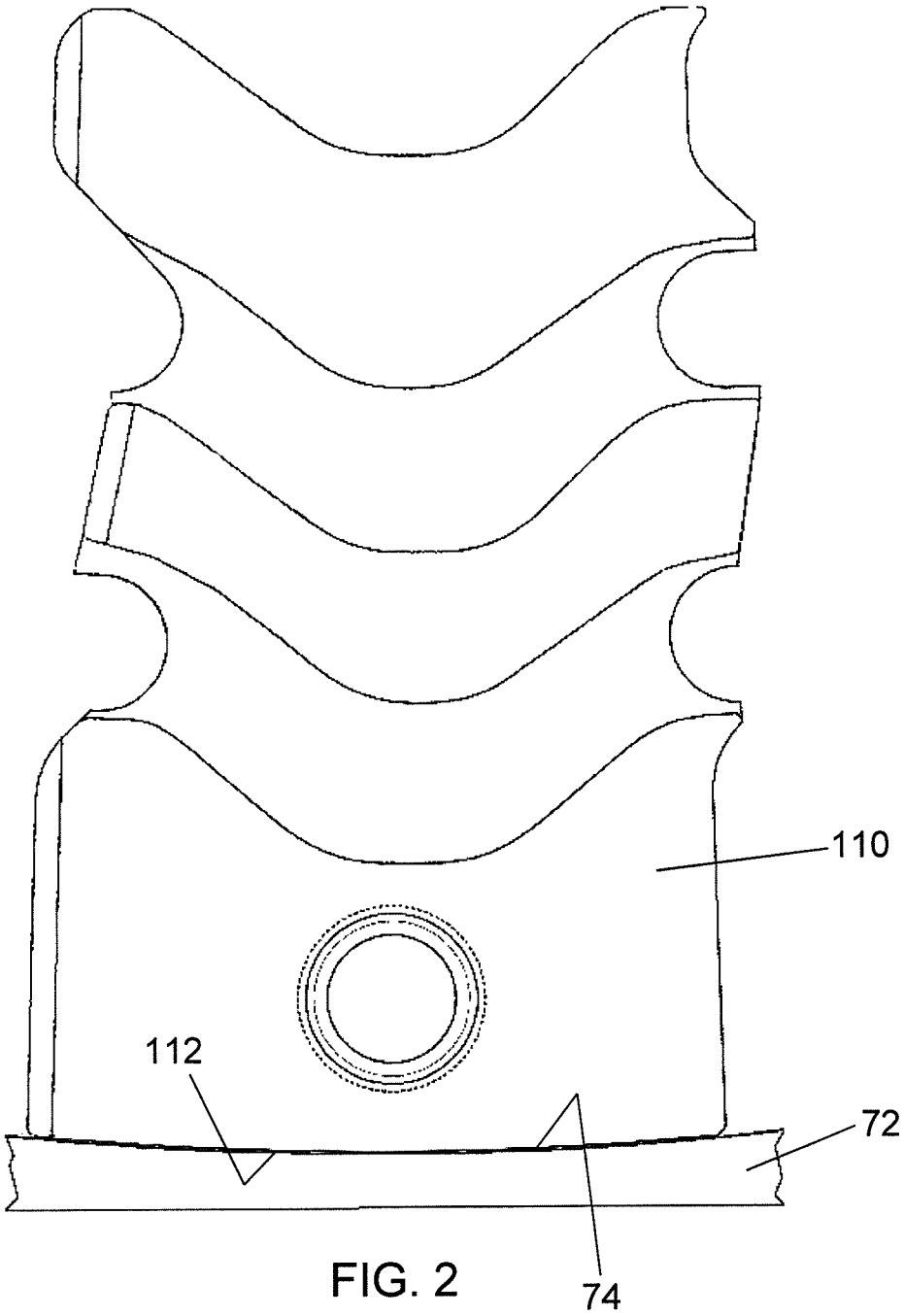
FIG. 2 shows a sinker cam segment located by a locating surface of the sinker cam cap in accordance with an embodiment of the present invention.

FIG. 2 shows an example of a locating surface of the sinker cam cap 72 defining a locating surface 74 that complements the abutting contact surface 112 of the sinker cam segment 110 at its radially outer end (i.e., the lower end in the orientation of FIG. 2). Before the segment 110 is screwed to the cam cap 72, the segment's contact surface 112 is urged against the complementary locating surface 74, and then the fastener is tightened to fix the segment in position.

Figure 3:
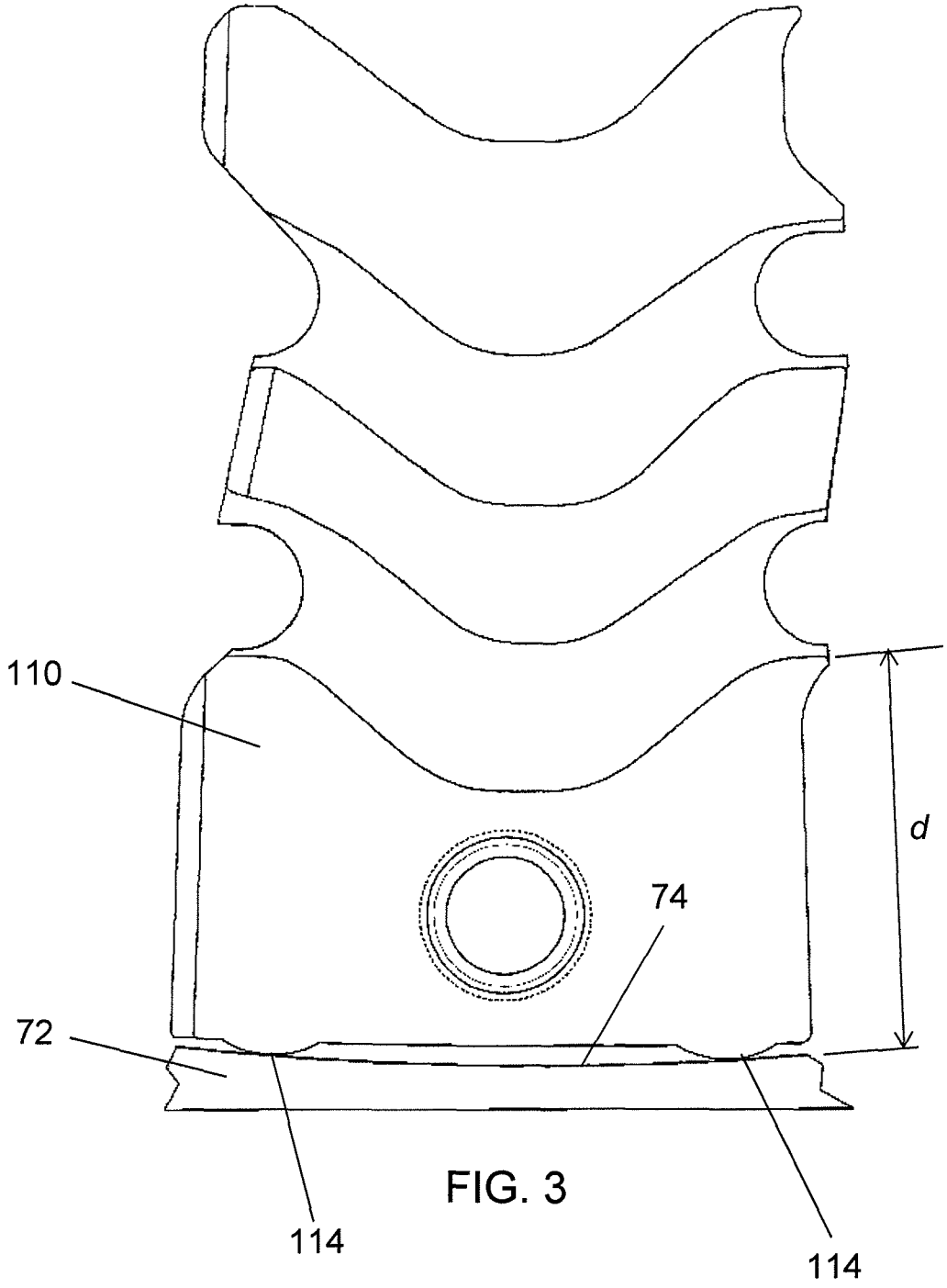
FIG. 3 shows a sinker cam segment located by a locating surface of the sinker cam cap in accordance with another embodiment of the present invention.

FIG. 3 shows an alternative embodiment. The sinker cam segment defines a radially outer end, the radially outer end defining a pair of discrete contact points 114 protruding generally radially outwardly therefrom, the contact points being spaced apart in a generally circumferential direction (i.e., generally left-to-right in the orientation of FIG. 3) along the radially outer end. The discrete contact points 114 on the sinker cam segment 110 engage the locating surface 74. The sinker cam segments according to this embodiment must be machined in such a way as to align the cam track to the contact points 114.

With either of the embodiments of FIGS. 2 and 3, and in all embodiments contemplated by the present invention, there is a predetermined positional relationship, with respect to a generally radial direction of movement of the sinkers, between the segment of the sinker cam track and the contact region, since the contact region 112, 114 is a reference surface for the positioning of the cam segment.

Any of these embodiments will yield a very low tolerance variation of a given sinker cam segment with respect to the generally radial movement direction of the sinkers.

Figure 1A:
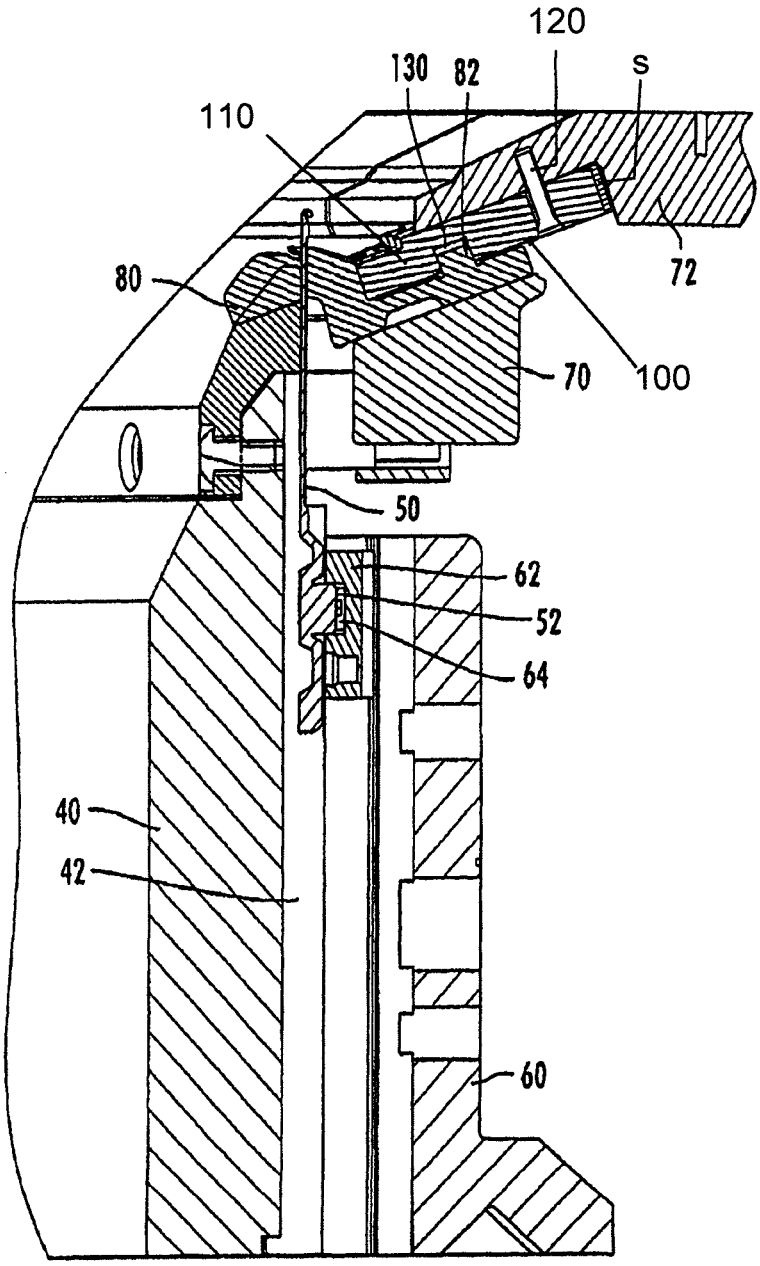
FIG. 1A is a view similar to FIG. 1, showing an alternative embodiment.

Variations in the concept can be envisioned. For example, although sinker cam radial positions are rarely changed, particularly on high-speed and fine-cut machines, if the radial location of all sinker cam segments or just one sinker cam segment needs to be adjusted for any reason, a spacer or shim S (FIG. 1A) can be inserted between the sinker cam segment 110 and the locating surface 74.

Also, sinker cam segments in accordance with FIG. 3 can include an ability to change the distance between the location points 114, and the locating surface 74 can be contoured in the vicinity of the cam segment, such as shown in FIG. 3, so that changing the distance between the locating points results in the cam segment being moved radially inward or radially outward, thereby adjusting the cam track location. This is sometimes needed for changing the "push" of selected sinkers.

Another method for changing the sinker push is to employ replacement sinker cam segments for certain sinker cam segments installed in the machine. Each replacement sinker cam segment defines a segment of a sinker cam track substantially identical to that of the installed sinker cam segment but located at a distance d (FIG. 3) from the contact region, measured along the generally radial direction, that differs by a predetermined amount from a corresponding distance of the installed sinker cam segment.

Many modifications and other embodiments of the inventions set forth herein will come to mind to one skilled in the art to which these inventions pertain having the benefit of the teachings presented in the foregoing descriptions and the associated drawings. For example, while the sinker cam segments illustrated herein have female cam tracks engaged by male sinker butts, it is well known in the art that alternatively the sinker cam tracks can comprise male elements that engage female elements in the sinkers. Accordingly, it will be understood that the term "sinker butt" as used herein is not limited to a male element on the sinker, but can also refer to a female element in the sinker. Other modifications can also be made to the embodiments shown herein. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. A circular knitting machine, comprising:

a cylinder;

needle cams disposed about the cylinder and defining a cam track having cam surfaces;

knitting needles having needle butts engaged in the cam track such that relative rotation between the cylinder and needle cams causes the needles to be raised and lowered by engagement between the cam surfaces and needle butts;

sinkers disposed about the cylinder, each of the sinkers having a sinker butt, the sinkers being arranged for inward and outward movement along a generally radial direction;

a sinker cam ring disposed about the cylinder and comprising a plurality of sinker cam segments arranged edge-to-edge to form the sinker cam ring, the sinker cam segments being mounted, by a fastening arrangement including fasteners, to a stationary sinker cap assembly of the machine;

each sinker cam segment defining a segment of a sinker cam track for the sinkers, each sinker cam segment having a contact region located at a generally radially outermost edge of the sinker cam segment, there being a predetermined positional relationship, with respect to the generally radial direction of movement of the sinkers, between the segment of the sinker cam track and the contact region, whereby the contact region forms a reference surface for positioning of the sinker cam segment with respect to the generally radial direction;

the sinker cap assembly defining a locating surface facing inwardly in the generally radial direction and opposing the contact region of each sinker cam segment;

wherein each sinker cam segment is structured and arranged to allow a defined amount of generally radially inward and outward adjustment relative to the sinker cap assembly such that the contact region of each sinker cam segment is urged toward the locating surface of the sinker cap assembly and is then fixed in place by the fastening arrangement, thereby determining a positioning of the sinker cam segment in the generally radial direction.

2. The circular knitting machine of claim 1, wherein the contact region of each sinker cam segment comprises a contact surface that has a complementary shape to that of the locating surface.

3. The circular knitting machine of claim 1, wherein the contact region of each sinker cam segment comprises discrete, spaced contact points that contact the locating surface.

4. The circular knitting machine of claim 3, wherein there are two spaced contact points.

5. The circular knitting machine of claim 4, wherein the sinker cam segments define a spacing distance between the contact points, and the locating surface is contoured such that said spacing distance is configured to define a generally radial position of the sinker cam segment.

6. The circular knitting machine of claim 1, wherein the machine further comprises at least one replacement sinker cam segment for each sinker cam segment installed in the machine, each replacement sinker cam segment defining a segment of a sinker cam track substantially identical to that of the installed sinker cam segment but located at a distance from the contact region, measured along the generally radial direction, that differs by a predetermined amount from a corresponding distance of the installed sinker cam segment.

7. The circular knitting machine of claim 1, further comprising shims for selected ones of the sinker cam segments, the shims being disposed between the contact regions of the selected sinker cam segments and the locating surface for adjusting a push of the selected sinkers.

8. A sinker cam ring for a circular knitting machine having sinkers, comprising:

a plurality of sinker cam segments arranged edge-to-edge to form the sinker cam ring, the sinker cam segments being mountable, by a fastening arrangement including fasteners, to a stationary sinker cap assembly of the machine;

each sinker cam segment defining a segment of a sinker cam track for the sinkers, each sinker cam segment having a contact region located at a generally radially outermost edge of the sinker cam segment, there being a predetermined positional relationship, with respect to a generally radial direction of movement of the sinkers, between the segment of the sinker cam track and the contact region, whereby the contact region forms a reference surface for positioning of the sinker cam segment with respect to the generally radial direction.

9. The sinker cam ring of claim 8, wherein the contact region of each sinker cam segment comprises a contact surface.

10. The sinker cam arrangement of claim 8, wherein the contact region of each sinker cam segment comprises discrete, spaced contact points.

11. The sinker cam arrangement of claim 10, wherein there are two spaced contact points.

12. The sinker cam arrangement of claim 11, wherein the sinker cam segments are configured to define a spacing distance between the contact points; and wherein the contact points are configured to cooperate with the locating surface of the stationary sinker cap assembly such that the spacing distance defines a generally radial position of the sinker cam segments relative to the sinker cap assembly.

13. A sinker cam segment defining a segment of a sinker cam track for sinkers in a circular knitting machine, the sinker cam segment having a contact region located at a generally radially outermost edge of the sinker cam segment, there being a predetermined positional relationship, with respect to a generally radial direction of movement of the sinkers, between the segment of the sinker cam track and the contact region, whereby the contact region forms a reference surface for positioning of the sinker cam segment with respect to the generally radial direction; and wherein the sinker cam segment is structured and arranged to allow a defined amount of generally radially inward and outward adjustment relative to the machine such that the contact region of the sinker cam segment is urged toward a locating surface of the machine and is then fixed in place by a fastening arrangement, thereby determining a positioning of the sinker cam segment in the generally radial direction.

14. The sinker cam segment of claim 13, wherein the sinker cam segment is a first sinker cam segment, and further comprising at least one replacement sinker cam segment for the first sinker cam segment, each replacement sinker cam segment defining a segment of a sinker cam track substantially identical to that of the first sinker cam segment but located at a distance from the contact region, measured along the generally radial direction, that differs by a predetermined amount from a corresponding distance of the first sinker cam segment.

15. The sinker cam segment of claim 13, further comprising a shim structured to be disposed between the contact region of the sinker cam segment and the locating surface of the machine for adjusting a push of the sinkers.

16. A method of knitting fabric on a circular knitting machine, the method comprising:

providing a knitting machine comprising:

a cylinder;

needle cams disposed about the cylinder and defining a cam track having cam surfaces, knitting needles having needle butts engaged in the cam track;

sinkers disposed about the cylinder, each of the sinkers having a sinker butt, the sinkers being arranged for inward and outward movement along a generally radial direction; and a sinker cam ring disposed about the cylinder and comprising a plurality of sinker cam segments arranged edge-to-edge to form the sinker cam ring, the sinker cam segments being mounted, by a fastening arrangement including fasteners, to a stationary sinker cap assembly of the machine, wherein each sinker cam segment defines a segment of a sinker cam track for the sinkers, each sinker cam segment having a contact region located at a generally radially outermost edge of the sinker cam segment, there being a predetermined positional relationship, with respect to the generally radial direction of movement of the sinkers, between the segment of the sinker cam track and the contact region, whereby the contact region forms a reference surface for positioning of the sinker cam segment with respect to the generally radial direction, wherein the sinker cap assembly defines a locating surface facing inwardly in the generally radial direction and opposing the contact region of each sinker cam segment, and wherein each sinker cam segment is structured and arranged to allow a defined amount of generally radially inward and outward adjustment relative to the sinker cap assembly such that the contact region of each sinker cam segment is urged toward the locating surface of the sinker cap assembly and is then fixed in place by the fastening arrangement, thereby determining a positioning of the sinker cam segment in the generally radial direction;

causing relative rotation between the cylinder and the needle cams so as to cause the needles to be raised and lowered by engagement between the cam surfaces and needle butts and to cause the sinkers to be advanced generally radially inwardly and retracted radially outwardly by engagement between the sinker butts and the sinker cam track; and feeding yarn to at least one knitting point such that the needles and sinkers knit a circularly knit fabric.

17. The method of claim 16 further comprising replacing at least one sinker cam segment with at least one replacement sinker cam segment, each replacement sinker cam segment defining a segment of a sinker cam track substantially identical to that of the installed sinker cam segment but located at a distance from the contact region, measured along the generally radial direction, that differs by a predetermined amount from a corresponding distance of the installed sinker cam segment.

18. The method of claim 16, wherein the contact region of each sinker cam segment comprises at least two discrete, spaced contact points that contact the locating surface, wherein the sinker cam segments are configured to define a spacing distance between the contact points, and wherein the locating surface is contoured such that said spacing distance defines a generally radial position of the sinker cam segment.

19. The method of claim 16, further comprising positioning at least one shim between the contact region of at least one sinker cam segment and the locating surface for adjusting a push of the sinker.

* * * * *